US009103299B2

(12) United States Patent
Warfel et al.

(10) Patent No.: US 9,103,299 B2
(45) Date of Patent: Aug. 11, 2015

(54) FUEL DELIVERY SYSTEM FOR AN INTERNAL COMBUSTION ENGINE

(71) Applicant: Husqvarna AB, Huskvarna (SE)

(72) Inventors: Paul Warfel, Davidson, NC (US); Neal Chandler, Shreveport, LA (US); Darien LaCroix, Texarkana, TX (US)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 14/559,373

(22) Filed: Dec. 3, 2014

(65) Prior Publication Data

US 2015/0083090 A1 Mar. 26, 2015

Related U.S. Application Data

(63) Continuation of application No. 13/513,845, filed as application No. PCT/US2009/066709 on Dec. 4, 2009, now Pat. No. 8,925,509.

(51) Int. Cl.

| | |
|---|---|
| ***F02M 1/16*** | (2006.01) |
| ***F02M 17/04*** | (2006.01) |
| ***F02M 1/02*** | (2006.01) |
| ***F02M 1/08*** | (2006.01) |

(52) U.S. Cl.

CPC ..... *F02M 17/04* (2013.01); *F02M 1/02* (2013.01); *F02M 1/08* (2013.01); *F02M 1/16* (2013.01)

(58) Field of Classification Search

CPC ..... F02M 1/16; F02M 1/04; F02M 1/08; F02M 17/04

USPC ..... 123/179.1, 179.11, 174; 261/36.1, 36.2

See application file for complete search history.

(56) References Cited

U.S. PATENT DOCUMENTS

| | | | | |
|---|---|---|---|---|
| 3,451,383 | A | 6/1969 | Nelson | |
| 4,375,206 | A * | 3/1983 | Baltz et al. | 123/179.11 |
| 4,396,558 | A | 8/1983 | Brunning | |
| 4,738,232 | A | 4/1988 | Scott | |
| 5,706,774 | A | 1/1998 | Shaw | |
| 5,750,056 | A | 5/1998 | Pitman et al. | |
| 5,891,369 | A | 4/1999 | Tuggle et al. | |
| 6,481,403 | B1 | 11/2002 | Ashcraft et al. | |
| 6,561,495 | B2 | 5/2003 | Woody | |
| 6,622,992 | B2 | 9/2003 | Woody | |

(Continued)

FOREIGN PATENT DOCUMENTS

| | | |
|---|---|---|
| EP | 1207294 A2 | 5/2002 |
| JP | 63138148 A2 | 6/1988 |

(Continued)

OTHER PUBLICATIONS

International Search Report and Written Opinion of PCT/US2009/066709 mailed on Sep. 3, 2010, all encloed pages cited.

(Continued)

*Primary Examiner* — Arnold Castro

(74) *Attorney, Agent, or Firm* — Nelson Mullins Riley & Scarborough LLP

(57) ABSTRACT

A fuel delivery system for an internal combustion engine. The fuel delivery system includes a diaphragm carburetor for mixing air and fuel, a start preparation system for introducing fuel into the carburetor before a start of the engine, and a fuel enrichment system for providing an enriched fuel and air mixture when the engine is cranked.

24 Claims, 5 Drawing Sheets

(56) References Cited

U.S. PATENT DOCUMENTS

| | | | |
|---|---|---|---|
| 6,899,072 | B2 | 5/2005 | Spitler |
| 7,334,551 | B2 | 2/2008 | Pattullo |
| 7,690,342 | B2 | 4/2010 | Gliniecki et al. |
| 7,913,659 | B2 | 3/2011 | Maupin |
| 2009/0314240 | A1 | 12/2009 | Maupin |

FOREIGN PATENT DOCUMENTS

| | | | |
|---|---|---|---|
| JP | 2002155801 | A | 5/2002 |
| JP | 2002155802 | A | 5/2002 |
| JP | 2002339804 | A | 11/2002 |
| WO | 2011068512 | A1 | 6/2011 |

OTHER PUBLICATIONS

Chapter II International Preliminary Report on Patentability of PCT/US2009/066709 mailed on Jan. 2, 2012, all enclosed pages cited.

Zama Group, Zama Technical Guide, Mar. 31, 2007, http://www.zamacarb.com.

* cited by examiner

FUEL DELIVERY SYSTEM FOR AN INTERNAL COMBUSTION ENGINE

CROSS-REFERENCE TO RELATED APPLICATIONS

This application is a continuation U.S. application Ser. No. 13/513,845 filed Jun. 4, 2012, which is a national phase entry of PCT/US2009/066709 filed Dec. 4, 2009, the entire contents of each of which are hereby incorporated herein by reference.

TECHNICAL FIELD

The present invention relates to a fuel delivery system. In particular, the present invention relates to fuel delivery systems for internal combustion engines which are used in hand-held power tools.

BACKGROUND

Hand-held power-tools such as, but not limited to, chain saws and line trimmers, are often powered by small two stroke internal combustion engines that are equipped with diaphragm carburetors.

Generally, a diaphragm carburetor has an air passage where fuel and air is mixed in a correct ratio. An outlet of the air passage leads to a crankcase of the engine. Typically, a throttle valve is provided in the air passage to control the amount of fuel and air mixture that enters the crankcase.

Usually, before starting an engine either a purging system or a priming system is actuated at least once to introduce fresh fuel into the carburetor. Typically, the purging system is used to remove residual air or fuel from the carburetor and fill desired fuel passages and chambers of the carburetor with the fresh fuel. On the other hand the priming system is used to inject a small quantity of fuel into the air passage, often in addition to performing the functions of a purging system. The fresh fuel supplied to the carburetor before starting the engine helps in an easy and quick starting of the engine. The purging system and the priming system are typically actuated by a purge bulb and a primer bulb respectively.

Further, the engines are also provided with a fuel enrichment system which is actuated in order to achieve a rich mixture of air and fuel (more fuel to air) during a cranking of the engine. The fuel enrichment system works by supplying extra fuel during the cranking of the engine, which facilitates a stable starting of the engine. One kind of a fuel enrichment system is the choke system. The choke system may include a butterfly or a slide valve located at the entrance of the carburetor (internal choke system). The valve can be moved between multiple positions via a lever, in order to control the air flow into the carburetor. The choke system may also be a separate system outside the carburetor (external choke system). The choke system is used to create an increased vacuum in the air passage, which draws extra fuel from fuel circuits of the carburetor. Another kind of fuel enrichment system includes a fuel enrichment circuit, which can be actuated by pressing a push button to introduce extra fuel into the air passage as soon as the engine cranking cycles are started. Sometimes both a choke system and a fuel enrichment circuit are used to enrich the fuel and air mixture.

To achieve an easy and quick starting of the engine followed by a stable cranking (typically by pulling a rope) may require actuation of multiple systems, for example a purging system or a priming system, and the choke valve and/or the fuel enrichment circuit. Therefore, the starting procedure for this kind of engines usually consists of three steps: 1) depressing a purge or primer bulb at least once, 2) actuating a fuel enrichment system and 3) pulling a rope to start the engine.

U.S. Pat. No. 7,334,551 issued on Feb. 26, 2008 to George M. Pattullo, titled "Combustion engine pull cord start system" describes a two-step starting system. In the two-step starting system taught by this patent, a pull-rope system of an internal combustion engine is linked to a throttle valve and a choke valve. The choke valve is actuated in different positions by a rope tension of the pull-cord system. However, the design is quite complex with many moving parts.

In light of the foregoing, there is a need for an improved two-step starting system, for an internal combustion engine, having a simple design with a lower number of moving parts.

SUMMARY

In view of the above, it is an objective to solve or at least reduce the problems discussed above. In particular, the objective is to provide an improved fuel delivery system, for an internal combustion engine of a handheld power tool, which has a simple design and a minimum number of moving parts and permits a two-step starting of the engine.

The objective is achieved with a novel fuel delivery system according to claim 1, in which the fuel delivery system includes a diaphragm carburetor, a start preparation system and a fuel enrichment system. The fuel enrichment system is connected to the start preparation system such that the fuel enrichment system can be activated by an actuation of the start preparation system. Thus, the fuel enrichment system need not be activated in a separate step. The start preparation system is utilized to introduce fuel into the diaphragm carburetor before the engine is started. Further, the fuel enrichment system provides a rich air and fuel mixture that is necessary for a stable initial operation of the engine when the engine is cranked.

According to claim 2, the start preparation system is provided with at least one first activation means and the fuel enrichment system is provided with at least one second activation means. The first activation means and the second activation means are connected to each other in such a way that the fuel enrichment system can be activated via the first activation means. This configuration permits a simple design of the fuel delivery system, thereby reducing a cost associated with manufacturing and maintenance.

According to claims 3 and 4, the first activation means may be a purge bulb or a primer bulb and the second activation means is a choke lever. According to claim 5, the first activation means, e.g. the purge bulb or the primer bulb, is configured in such a manner that the start preparation system can be activated at least once before a start of the engine. According to claims 6 and 7, the start preparation system is a purging system including the purge bulb. The purge bulb is depressed at least once to actuate the purging system. The purging system removes residual air and/or fuel and introduces fresh fuel in the diaphragm carburetor. According to claims 8 and 9, the start preparation system is a priming system including the primer bulb. The primer bulb is depressed at least once to actuate the priming system. The priming system injects a fresh amount of fuel in a venturi of the diaphragm carburetor, via an auxiliary circuit, often in addition to performing the functions of a purging system. According to claim 10, the fuel enrichment system is actuated by the depression of the purge bulb or the primer bulb.

According to claim 11, the diaphragm carburetor also includes a throttle valve. The throttle valve is a butterfly throttle valve.

According to claim 12, the fuel enrichment system includes a choke system. The choke system is utilized to reduce an amount of air entering the diaphragm carburetor. The reduction in the amount of air results in a rich fuel and air mixture. The choke system can be actuated by the choke lever and the choke lever is connected to the start preparation system.

According to claim 13, the fuel enrichment system includes an enrichment circuit. The enrichment circuit injects a fresh amount of fuel in the venturi of the diaphragm carburetor when the engine is being cranked. The enrichment circuit is activated by means of a push button. The push button is connected to the start preparation system.

According to claims 14 and 15, the fuel enrichment system includes an enrichment circuit as well as a choke system. The presence of both the enrichment circuit and the choke system results in a richer fuel and air mixture. The enrichment circuit and the choke system are connected to each other such that the enrichment circuit is actuated when the choke system is activated. Further, the choke system is linked to the start preparation system.

According to claims 16 and 17, the fuel enrichment system includes an enrichment circuit as well as a choke system. The enrichment circuit and the choke system are connected to each other such that the choke system is actuated when the enrichment circuit is activated. Further, the enrichment circuit is linked to the start preparation system.

According to claim 18, the throttle valve of the carburetor is a rotating throttle valve.

According to claim 19, the fuel enrichment system includes an enrichment circuit. The enrichment circuit is activated by means of a push button. The push button is connected to the start preparation system.

According to claim 20, the fuel delivery system includes a choke system which is external to the diaphragm carburetor. The choke system is actuated by means of a choke lever. The choke lever is connected to the start preparation system.

BRIEF DESCRIPTION OF THE DRAWINGS

The invention will in the following be described in more detail with reference to the enclosed drawings, wherein.

DESCRIPTION OF EMBODIMENTS

Figure 1:
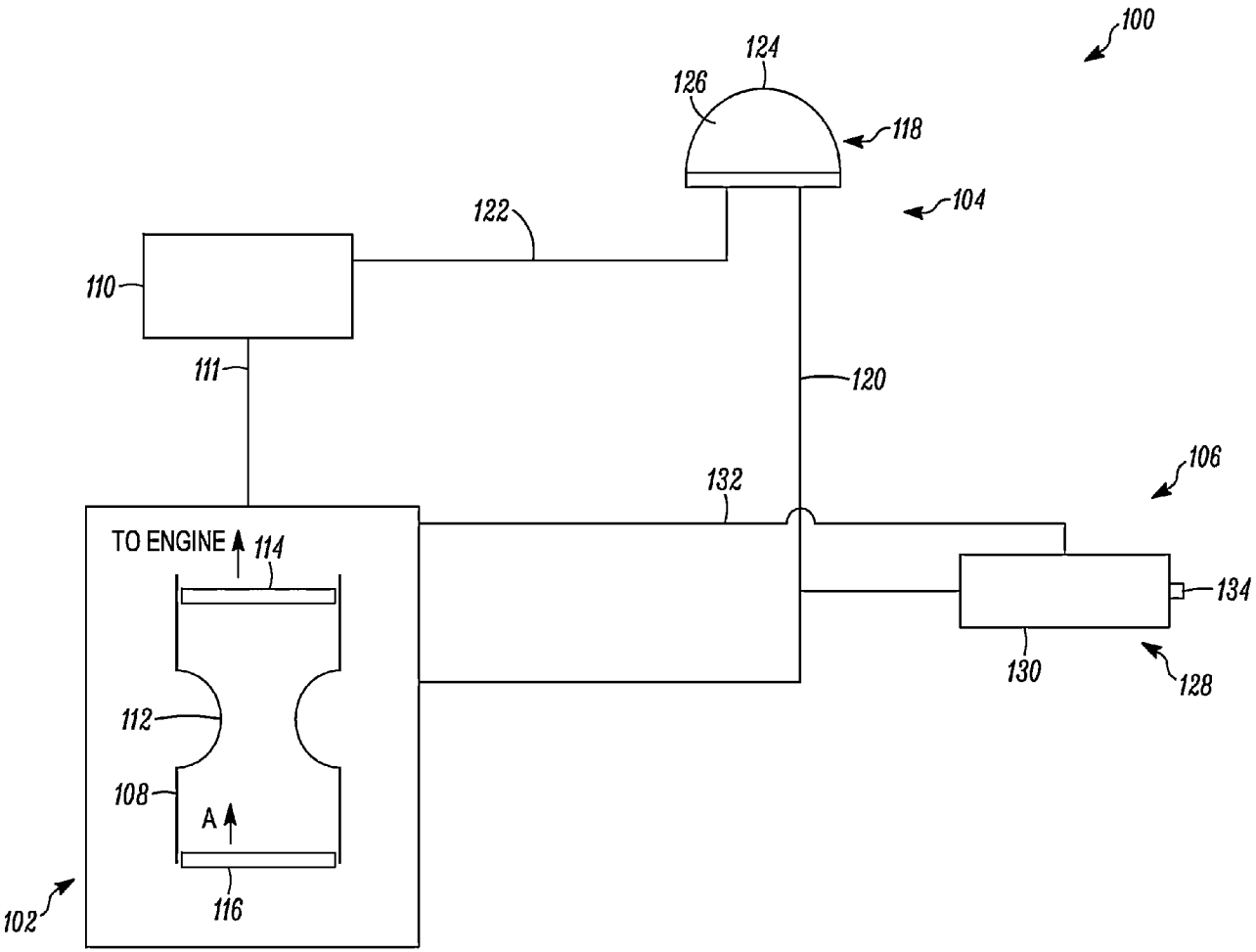
FIG. 1 shows a schematic view of a fuel delivery system, according to an embodiment of the present invention.

The present invention will be described more fully hereinafter with reference to the accompanying drawings, in which example embodiments of the invention incorporating one or more aspects of the present invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. For example, one or more aspects of the present invention can be utilized in other embodiments and even other types of devices. In the drawings, like numbers refer to like elements.

FIG. 1 shows a schematic view of an example fuel delivery system 100 for an internal combustion engine (not shown in FIG. 1) incorporating various embodiments of the present invention. In an embodiment of the present invention, the fuel delivery system 100 includes a diaphragm carburetor 102, a start preparation system 104 and a fuel enrichment system 106.

The diaphragm carburetor 102 may supply a fuel and air mixture to the engine. In an embodiment of the present invention, the diaphragm carburetor 102 may include a fuel and air mixing passage 108, a fuel pump system (not shown in FIG. 1) and a fuel metering system (not shown in FIG. 1). As shown in the exemplary embodiment of FIG. 1, air may be inducted from the atmosphere in a direction A into the fuel and air mixing passage 108. Further, fuel from a fuel supply tank 110 may be supplied to the fuel and air mixing passage 108 using a fuel inlet line 111 via the fuel pump system and the fuel metering system. In an embodiment of the present invention, pressure pulses from the crankcase of the engine may be utilized to cause a movement of a diaphragm in the fuel pump system and draw fuel from the fuel supply tank 110 into the fuel metering system. The fuel metering system may supply fuel through one or more openings (not shown in FIG. 1) into the fuel and air mixing passage 108. While the fuel and air mixing passage 108 will be described in detail below, other components of the carburetor will not be further described, since they are not part of the present invention, are of a conventional type and belong to the knowledge of a person skilled in the art.

As shown in FIG. 1, the fuel and air mixing passage 108 may include a venturi 112 and a throttle valve 114. The throttle valve 114 is disposed downstream of the venturi 112. The throttle valve 114 may be rotatably mounted in the fuel and air mixing passage 108 such that the throttle valve 114 may be oriented at multiple positions to regulate an amount of fuel and air mixture that enters the engine. The multiple positions may include an idle position, a part throttle position and a full throttle position. In an embodiment of the present invention, the throttle valve 114 may be a butterfly valve. In another embodiment of the present invention, the throttle valve 114 may be a rotating valve. In an embodiment of the present invention, the throttle valve 114 may be actuated by means of a throttle lever (not shown in FIG. 1) in the multiple positions.

In an embodiment of the present invention, a choke valve 116 may be provided upstream of the fuel and air mixing passage 108. In an embodiment of the present invention, the choke valve 116 may be an integral part of the diaphragm carburetor 102. In another embodiment of the present invention, the choke valve 116 may be an external choke which may be separate from the diaphragm carburetor 102. Further, the choke valve 116 may be oriented at multiple positions to regulate an amount of air that enters the fuel and air mixing passage 108. The multiple positions of the choke valve 116 may include, but not limiting to, a closed choke position, a half choke position and an open choke position. The choke valve 116 may be a part of the choke system (not shown in FIG. 1) which may include a choke lever (not shown in FIG. 1) to actuate the choke valve 116 in the multiple positions.

The fuel delivery system 100, as described above, may be used for the internal combustion engine in various hand-held power tools. However, in a non-operational state of the engine, various components of the diaphragm carburetor 102 may contain a residual air and/or fuel. The start preparation system 104 may remove a residual air and/or fuel from the various components of the diaphragm carburetor 102 and/or introduce a fresh fuel before a start of the engine. The start preparation system 104 may include a first activation means to activate the start preparation system 104.

In an embodiment of the present invention, the start preparation system 104 may include a bulb assembly 118, a bulb inlet line 120 and a bulb outlet line 122. The bulb assembly 118 may include a resilient domed bulb 124 to define a bulb chamber 126. The bulb 124 may act as the first activation means to actuate the start preparation system 104 by a depression of the bulb 124. In an embodiment of the present invention, the start preparation system 104 may be a purging system and the bulb assembly 118 may be a purge bulb assembly. In this case, the bulb 124 may be a purge bulb which may be depressed to actuate the purging system. Before a start of the engine, a depression of the bulb 124 may cause a decrease in a volume of the bulb chamber 126 and a consequent increase in pressure inside the bulb chamber 126. The increase in pressure may force a fluid inside the bulb chamber 126 to be expelled through the bulb outlet line 122 to the fuel supply tank 110. The fluid inside the bulb chamber 126 may be air or a mixture of fuel and air. As the bulb 124 is released, it may return to its original shape, thereby decreasing the pressure inside the bulb chamber 126. This may result in a flow of a residual fuel and/or air from one or more components of the diaphragm carburetor 102, for example the fuel metering system, to the bulb chamber 126 via the bulb inlet line 120. In an embodiment of the present invention, repeated depressions of the bulb 124 may draw a fresh fuel from the fuel supply tank 110. Thus, the start preparation system 104 working as the purging system may fill one or more components of the diaphragm carburetor 102 with fresh fuel from the fuel supply tank 110.

In another embodiment of the present invention, the start preparation system 104 may be a priming system and the bulb assembly 118 may be a primer bulb assembly. In this case, the bulb 124 may be a primer bulb which may be depressed to actuate the priming system. The priming system may include an auxiliary circuit (not shown in FIG. 1) which introduces fuel into the venturi 112 before a start of the engine, often in addition to the components of the purging system. Similar to the purging system, the priming system may be actuated by one or more depressions of the bulb 124. In various other embodiments of the present invention, the start preparation system 104 may include any other known systems to remove residual air and/or fuel from the diaphragm carburetor 102, to draw fresh fuel into the diaphragm carburetor 102 from the fuel supply tank 110 and/or to inject fuel in the fuel and air mixing passage 108. It is apparent to a person ordinarily skilled in the art that the exemplary embodiments of the start preparation system 104 shown in FIG. 1 do not limit the scope of the present invention.

After the removal of a residual air and/or fuel by the start preparation system 104, the fuel enrichment system 106 may be used to provide an enriched fuel and air mixture to the engine when the engine is cranked. The fuel enrichment system 106 may be provided with a second activation means to activate the fuel enrichment system 106. In an embodiment of the present invention, the fuel enrichment system 106 may include an enrichment circuit 128. The enrichment circuit 128 may be used to supply an additional amount of fuel to the fuel and air mixing passage 108 during a cranking of the engine. In an embodiment of the present invention, the enrichment circuit 128 may include an enrichment chamber 130 and an enrichment line 132. The enrichment chamber 130 may be connected to the bulb inlet line 120 such that it permits a flow of the fuel from the bulb inlet line 120 into the enrichment chamber 130. Further, the enrichment line 132 may be provided between the diaphragm carburetor 102 and the enrichment chamber 130 and may have one or more openings (not shown in FIG. 1) at the venturi 112 of the fuel and air mixing passage 108. In an embodiment of the present invention, the one or more openings may be placed at any location upstream of the throttle valve 114 in the fuel and air mixing passage 108. In an embodiment of the present invention, the enrichment circuit 128 may be actuated by a push button 134 such that the push button 134 may act as the second activation means. In an embodiment of the present invention, the push button 134 may be depressed to introduce fuel into the venturi 112 via the enrichment line 132. In various other embodiments of the present invention, the fuel enrichment system 106 may include any other known systems to supply fuel to the venturi 112 when the engine is cranked. It is apparent to a person ordinarily skilled in the art that the exemplary embodiment of the fuel enrichment system 106 shown in FIG. 1 does not limit the scope of the present invention.

In another embodiment of the present invention, fuel enrichment system 106 may include only the choke system and the choke lever may act as the second activation means. As described above, the choke system may be used to create an enriched fuel and air mixture by decreasing an amount of air entering the fuel and air mixing passage 108.

In another embodiment of the present invention, the fuel enrichment system 106 may include both the choke system and the enrichment circuit 128. In various embodiments of the present invention, the second activation means may include, for example but not limiting to, the choke lever and/or the push button 134 associated with the choke system and/or the enrichment circuit 128 respectively.

In another embodiment of the present invention, the fuel enrichment system 106 and the start preparation system 104 may be connected in such a way that the fuel enrichment system 106 may be activated by an activation of the start preparation system 104. The first activation means of the start preparation system 104 and the second activation means of the fuel enrichment system 106 may be connected to each other in such a way that the fuel enrichment system 106 may be activated by the first activation means. In an embodiment of the present invention, the bulb 124 of the start preparation system 104 may be connected to the choke lever or the push button 134 in such a way that the fuel enrichment system 106 may be activated by depressing the bulb 124.

In an embodiment of the present invention, the enrichment circuit 128 and the choke system may be connected such that an activation of the choke system may result in an actuation of the enrichment circuit 128. In an embodiment of the present invention, the choke lever of the choke system and the push button 134 may be connected to each other in such a way that the enrichment circuit 128 may be activated by the choke lever. Further, the choke system may be connected to the start preparation system 104. In an embodiment of the invention of the present invention, the bulb 124 of the start preparation system 104 may be connected to the choke lever.

In an embodiment of the present invention, the enrichment circuit 128 and the choke system may be connected in such a way that an activation of the enrichment circuit 128 may result in an actuation of the choke system. In an embodiment of the present invention, the choke lever of the choke system and the push button 134 may be connected to each other in such a way that the choke system may be activated by the push button 134. Further, the enrichment circuit 128 may be connected to the start preparation system 104. In an embodiment of the invention of the present invention, the bulb 124 of the start preparation system 104 may be connected to the push button 134.

Figure 2:
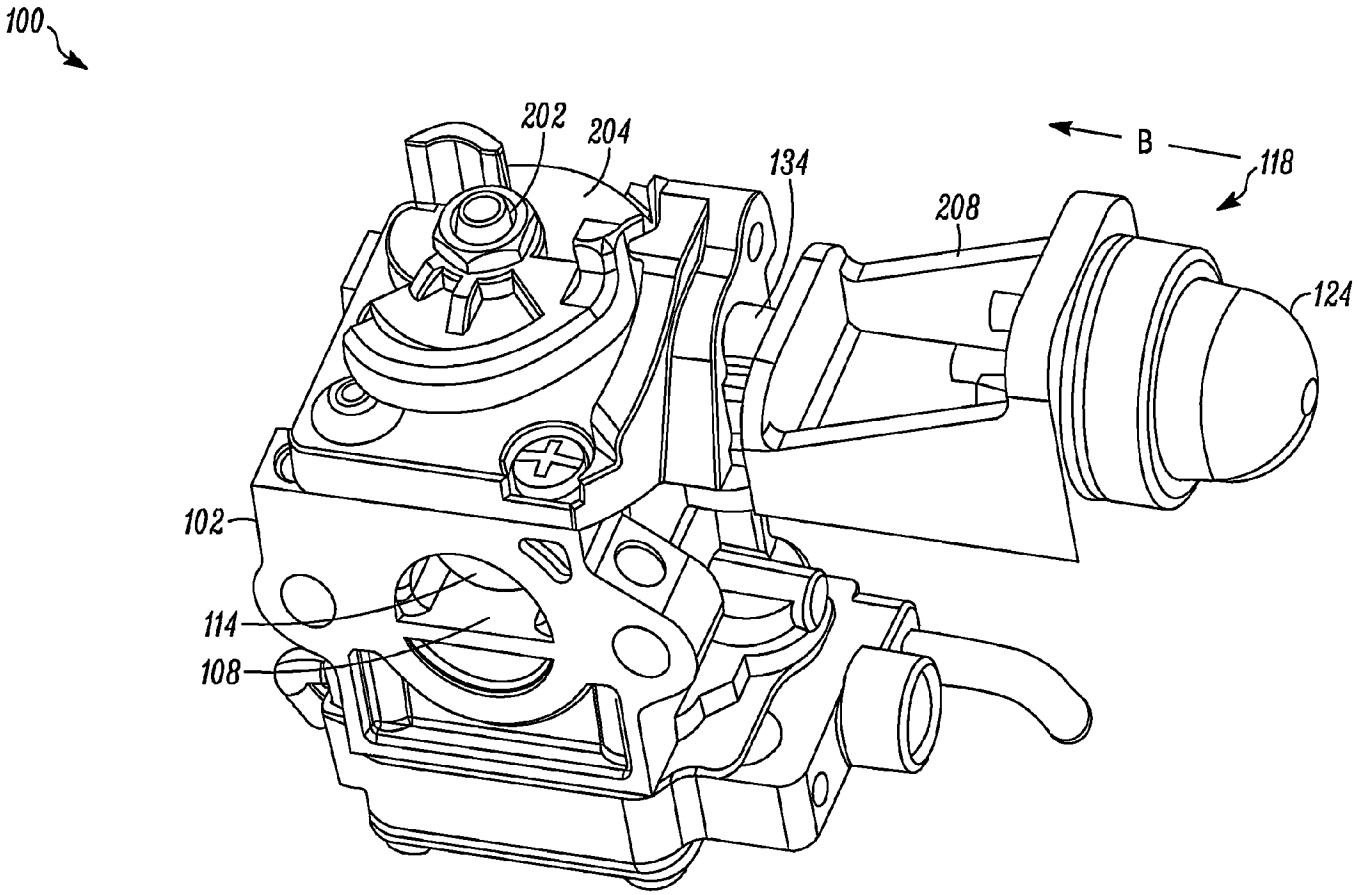
FIG. 2 shows a perspective view of a carburetor with a purge or primer bulb connected to a fuel enrichment circuit, according to an embodiment of the present invention.

FIG. 2 shows a perspective view of part of the fuel delivery system 100 according to an example embodiment of the present invention. The fuel delivery system 100 may include the diaphragm carburetor 102 and the bulb assembly 118. The diaphragm carburetor 102 may include the fuel and air mixing passage 108. The throttle valve 114 may be disposed in the fuel and air mixing passage 108. In an embodiment of the present invention, the throttle valve 114 may be a rotating throttle valve. The rotating throttle valve 114 may include a cylindrical valve body with a valve bore (not shown in FIG. 2). The rotating throttle valve 114 may be rotatably mounted in the fuel and air mixing passage 108 to cause the valve bore to be selectively aligned or misaligned with the fuel and air mixing passage 108. The rotating throttle valve 114 may be rotated by means of a throttle shaft 202 which is connected to the rotating throttle valve 114. The throttle shaft 202 may extend upwards through a cover plate 204. In an embodiment of the present invention, the throttle shaft 202 may be actuated by means of the throttle lever (not shown in FIG. 2). In an embodiment of the present invention, a push button 134 may be provided to activate the enrichment circuit 128 of the fuel delivery system 100 as described in FIG. 1. In this case, the bulb assembly 118 together with at least the bulb inlet line 120 (not shown in FIG. 2) and the bulb outlet line 122 (not shown in FIG. 2) may act as the start preparation system 104 and the enrichment circuit 128 may act as the fuel enrichment system 106. Further, the push button 134 may be integrated with the bulb assembly 118 via a connecting part 208. In an embodiment of the present invention, the bulb 124 may be a purge bulb which may activate a purging system of the fuel delivery system 100. In another embodiment of the present invention, the bulb 124 may be a primer bulb which may activate a priming system of the fuel delivery system 100. When the bulb 124 is depressed, the bulb 124 may be displaced in a direction B from a first position to a second position. The movement of the bulb 124 may be transmitted to the push button 134 through the connecting part 208. As a result, the push button 134 may get pressed to actuate the enrichment circuit 128. Thus, an action of actuating the purging system or priming system by the depression of the bulb 124 may also result in an actuation of the enrichment circuit 128. Further depression(s) of the bulb 124 may not influence the position of the push button 134 because the push button 134 is already in an actuated position. In an embodiment of the present invention, an actuation of the throttle lever by manual or automatic means may automatically reset the bulb assembly 118 to a first position. Consequently, the push button 134 may be released to a non-actuated position and the enrichment circuit 128 is deactivated.

In an alternative embodiment of the present invention, the throttle valve 114 may be a butterfly throttle valve. In such a case, the fuel enrichment system 106 may include the choke system (not shown in FIG. 2) in addition to the enrichment circuit 128. In an embodiment of the present invention, the depression of the bulb 124 and a subsequent activation of the enrichment circuit 128 may also actuate the choke system. In an embodiment of the present invention, the push button 134 may be linked to the choke lever of the choke system. In another embodiment of the present invention, the choke system may be actuated by a separate means.

Figure 3:
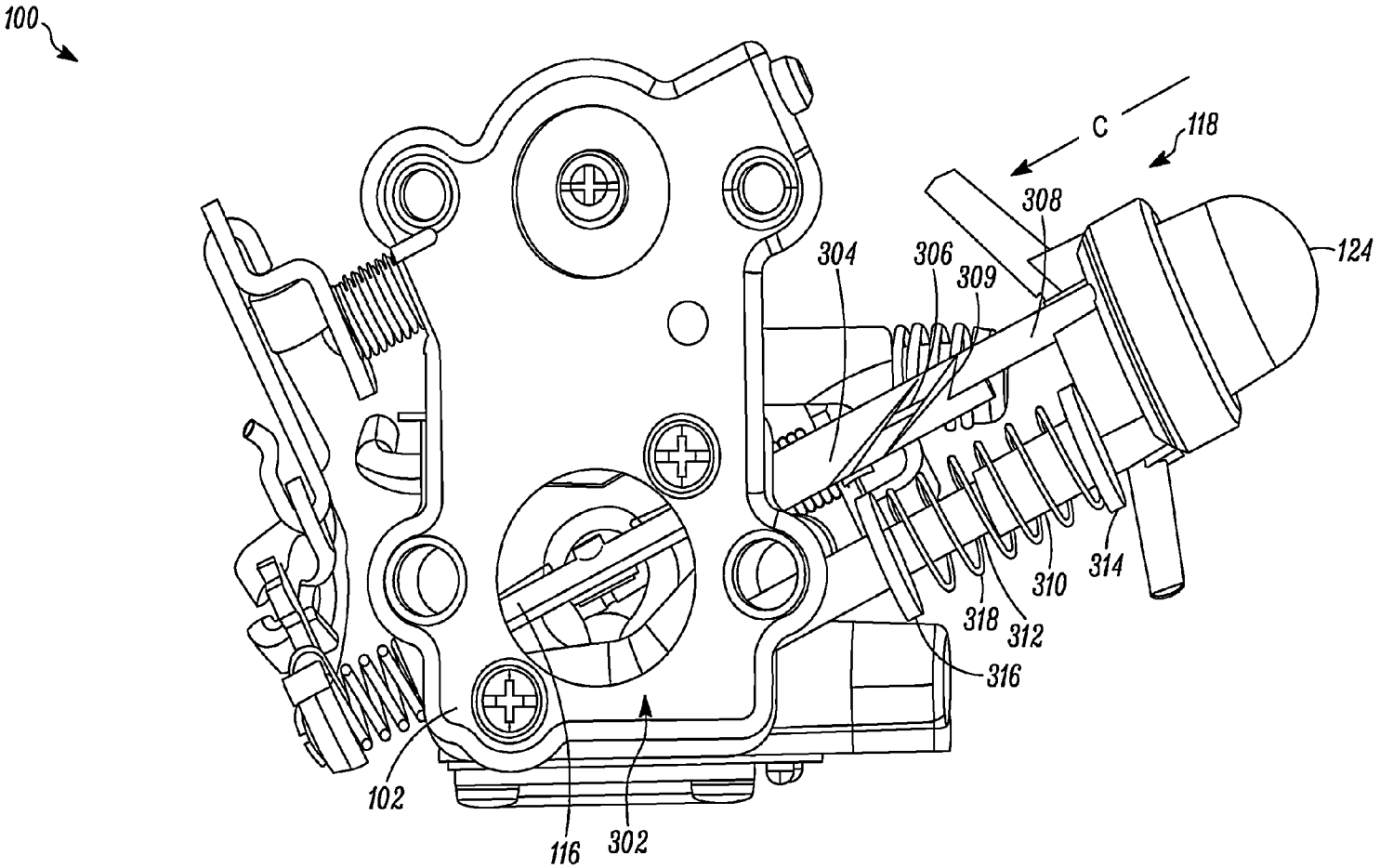
FIG. 3 shows a front view of a carburetor with a purge or primer bulb connected to a choke system, according to an embodiment of the present invention.

FIG. 3 shows a front view of part of the fuel delivery system 100 according to an example embodiment of the present invention. The fuel delivery system 100 may include the diaphragm carburetor 102 and a choke system 302. The choke system 302 may at least form part of the fuel enrichment system 106 as described in FIG. 1. In an embodiment of the present invention, the choke system 302, including the choke valve 116, may be integrated with the diaphragm carburetor 102. In an embodiment of the present invention, the choke valve 116 may be a butterfly valve. The choke system 302 may include a choke rod 304 connected to the choke valve 116. The choke rod 304 may act as the second activation means. The choke valve 116 may be mounted on the choke rod 304 such that a rotation of the choke rod 304 may actuate the choke valve 116. The choke rod 304 may also include a cam member 306. A cam actuating member 308 may be connected to the bulb assembly 118. In an embodiment of the present invention, the cam actuating member 308 may be an elongate shaft with a contact end 309. The contact end 309 may be provided so that the cam actuating member 308 may engage with the cam member 306. The bulb assembly 118 may be mounted on a first support shaft 310. The first support shaft 310 may be connected telescopically to a second support shaft 312. As shown in the exemplary embodiment of FIG. 3, an outer diameter of the first support shaft 310 is larger than an outer diameter of the second support shaft 312. However, in other embodiments of the present invention, the outer diameter of the first support shaft 310 may be smaller than the outer diameter of the second support shaft 312. The second support shaft 312 may be fixed with the diaphragm carburetor 102. A first annular projection 314 and a second annular projection 316 may be provided on the first support shaft 310 and the second support shaft 312 respectively. Further, a helical spring 318 may be disposed between the first annular projection 314 and the second annular position 316. The helical spring 318 may normally bias the annular projections 314 and 316 apart, and retain the bulb assembly 118 in a non-actuating position.

In an embodiment of the present invention, before a start of the engine, the choke valve 116 may be in an open choke position. The bulb assembly 118 together with at least the bulb inlet line 120 (not shown in FIG. 3) and the bulb outlet line 122 (not shown in FIG. 3) may act as the start preparation system 104 and when the bulb 124 is depressed in a direction C it actuates a purging system or a priming system. As a result of the depression of the bulb 124, the bulb assembly 118 may be displaced from a non-actuating to an actuating position by overcoming a biasing force of the helical spring 318. The first support shaft 310 may slide telescopically over the second support shaft 312 to enable the displacement of the bulb assembly 118. Consequently, the cam actuating member 308 may also be displaced in the direction C. The contact end 309 of the cam actuating member 308 may engage with the cam member 306 and cause the cam member 306 to rotate. The choke rod 304 may also rotate with the cam member 306, thereby actuating the choke valve 116 in a closed choke position. In a closed choke position, the amount of air entering the fuel and air mixing passage 108 may be reduced and an enriched fuel and air mixture may be formed when the engine is cranked. An actuating position of the bulb assembly 118 may correspond to a maximum telescopic displacement of the first support shaft 310 over the second support shaft 312 in the direction C. Thus, further depression(s) of the bulb 124 may not influence the position of the choke rod 304 and the choke valve 116 may remain in a closed choke position. Once the bulb assembly 118 is depressed to an actuating position, the bulb assembly 118 may be held in place by a locking mechanism. In an embodiment of the present invention, the actuation of the throttle lever by manual or automatic means may automatically release the locking mechanism and reset the bulb assembly 118 to a non-actuating position. As a result, the choke valve 116 may be actuated to an open choke position once the engine has started. In another embodiment of the present invention, the bulb assembly 118 may be depressed to an intermediate actuating position which may correspond to a half choke position of the choke valve 116. An intermediate actuating position may be located at an intermediate position between a non-actuating position and an actuating position of the bulb assembly 118. In an embodiment of the present invention, the bulb assembly 118 may be held in place at an intermediate actuating position by the locking mechanism. However, if the bulb 124 is depressed further at an intermediate actuating position, the locking mechanism may be released to enable the bulb assembly 118 to move to an actuating position and hence, actuate the choke valve 116 to a closed choke position.

In an embodiment of the present invention, the fuel delivery system 100 may also include the enrichment circuit 128 in addition to the choke system 302. The enrichment circuit 128 may be activated when the choke rod 304 is rotated by a movement of the bulb assembly 118 in the direction C. Thus, the actuation of the choke system 302 may also result in the activation of the enrichment circuit 128. In an embodiment of the invention the choke rod 304 of the choke system may be connected to the push button 134 of the enrichment circuit 128.

Figure 4:
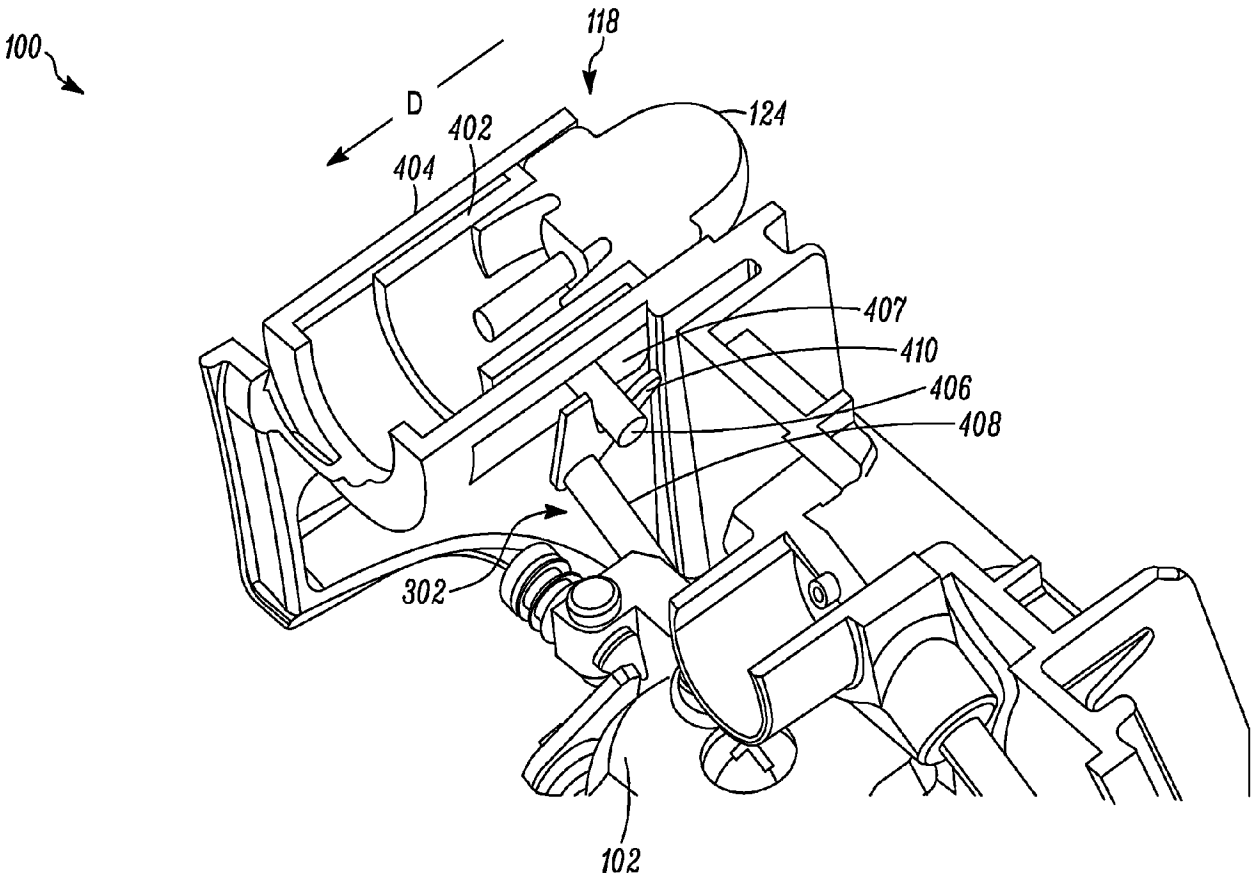
FIG. 4 shows a perspective view of a carburetor with a purge or primer bulb connected to a choke system, according to an embodiment of the present invention.

FIG. 4 shows a sectional perspective view of part of the fuel delivery system 100 according to an example embodiment of the present invention. As shown in the exemplary embodiment of FIG. 4, the fuel delivery system 100 includes the diaphragm carburetor 102 and the choke system 302. The choke system 302 may at least form part of the fuel enrichment system 106. In an embodiment of the present invention, the choke system 302, including the choke valve 116 (not shown in FIG. 4), may be integrated with the diaphragm carburetor 102. In an embodiment of the present invention, the choke valve 116 may be a butterfly valve. The bulb assembly 118 may be connected to a sliding member 402. The bulb assembly 118 and the sliding member 402 may be disposed in a bulb housing 404. The sliding member 402 may enable the bulb assembly 118 to be displaced in a direction D from a non-actuating position to an actuating position when the bulb 124 is depressed. In FIG. 4, the sliding member 402 and the bulb housing 404 are shown to be substantially cylindrical in shape. However, other shapes and configurations of the sliding member 402 and the bulb housing 404 may be envisioned without departing from the essence of the present invention. The sliding member 402 may include a first engaging member 406. In an embodiment of the present invention, the first engaging member 406 may be an elongate shaft with a cylindrical cross-section. The bulb housing 404 may have a slot 407 to enable the first engaging member 406 to be displaced in a range of displacement from a first position to a second position. A length of the slot 407 is chosen such that the length may allow at least the range of displacement of the first engaging member 406. A first position and a second position of the first engaging member 406 may correspond to a non-actuating position and an actuating position of the bulb assembly 118 respectively. Further, the choke system 302 may include a choke actuating lever 408. In an embodiment of the present invention, the choke actuating lever 408 may be the second activation means. The choke actuating lever 408 may be connected to the choke valve 116 such that a rotation of the choke actuating lever 408 may actuate the choke valve 116. The choke actuating lever 408 may include a second engaging member 410 that may engage with the first engaging member 406. In an embodiment of the present invention, the second engaging member 410 may be L-shaped to enable a stable engagement between the first engaging member 406 and the second engaging member 410 in the range of displacement of the first engaging member 406.

In an embodiment of the present invention, before a start of the engine, the bulb assembly 118 is in a non-actuating position and the first engaging member 406 is in a first position. A corresponding orientation of the choke actuating lever 408 may be such that the choke valve 116 may be in an open choke position. In this case, the bulb assembly 118 may act as the start preparation system 104 and when the bulb 124 is depressed to activate a purging system or a priming system, the bulb assembly 118 may be displaced in the direction D from a non-actuating position to an actuating position. Consequently, the first engaging member 406 may be displaced from a first position to a second position along the slot 407. Thus, the choke actuating lever 408 may rotate to actuate the choke valve 116 in a closed choke position. The length of the slot 407 may be such that it may prevent further displacement of the bulb assembly 118 along the direction D even when the bulb 124 is depressed. Once the bulb assembly 118 is depressed to an actuating position, the bulb assembly 118 may be held in place by a locking system. In an embodiment of the present invention, the actuation of the throttle lever by manual or automatic means may automatically release the locking system and reset the bulb assembly 118 to a non-actuating position.

Figure 5:
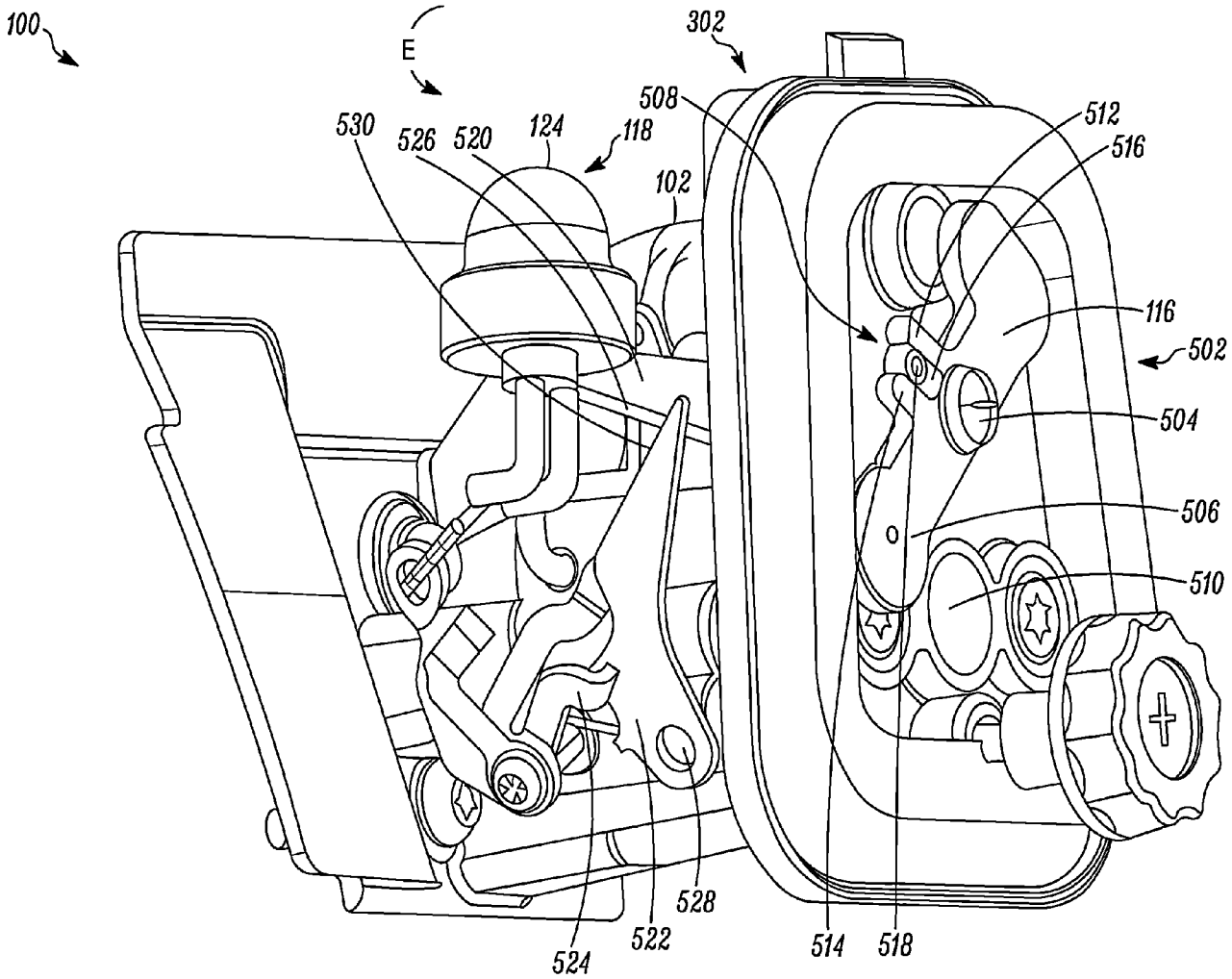
FIG. 5 shows a perspective view of a carburetor with an external choke system, according to an embodiment of the present invention.

FIG. 5 shows a perspective view of part of the fuel delivery system 100 according to an example embodiment of the present invention. As shown in the exemplary embodiment of FIG. 5, the fuel delivery system 100 includes the diaphragm carburetor 102 and the choke system 302. The choke system 302 may at least form part of the fuel enrichment system 106. In an embodiment of the present invention, at least a part of the choke system 302, for example but not limiting to the choke valve 116, may be external to the diaphragm carburetor 102. The choke valve 116 may be an external choke valve that is provided in an airbox 502. In an embodiment of the present invention, the external choke valve 116 may be mounted on a pivot 504. The external choke valve 116 may include a valve end 506 and an actuating portion 508. The valve end 506 may regulate the amount of air entering an air intake port 510. Air may be inducted into the fuel and air mixing passage 108 (not shown in FIG. 5) through the air intake port 510. The valve end 506 may be of a substantially circular shape to conform to a circular cross-section of the air intake port 510. However, other shapes and configurations of the valve end 506, and the air intake port 510 may be possible. The actuating portion 508 may include two projections 512 and 514. The projections 512 and 514 may define a channel 516 that may accept an actuating pin 518. The external choke valve 116 may be in an open choke position and a closed choke position when the actuating pin 518 is in a non-actuating position and an actuating position respectively. The actuating pin 518 may be connected to an external choke actuating lever 520. The external choke actuating lever 520 may be movable between a first position and second position. Corresponding to a first position and a second position of the external choke actuating lever 520, the actuating pin 518 may be movable between a non-actuating position and an actuating position respectively. In an embodiment of the present invention, the external choke actuating lever 520 may act as the second activation means. The bulb assembly 118 may be connected to the external choke actuating lever 520. The bulb assembly 118, together with the external choke actuating lever 520, may move pivotally in a direction E from a first position to a second position. As shown in the exemplary embodiment of FIG. 5, the direction E may be counter clockwise. However, in other embodiments of the present invention, the direction E may be clockwise.

In an embodiment of the present invention, before a start of the engine, the external choke actuating lever 520 and the actuating pin 518 may be in a first position and a non-actuating position respectively. Consequently, the external choke valve 116 may be in an open choke position. In this case, the bulb assembly 118 together with at least the bulb inlet line 120 (not shown in FIG. 5) and the bulb outlet line 122 (not shown in FIG. 5) may act as the start preparation system 104. When the bulb 124 is depressed to actuate a purging system or a priming system, the bulb assembly 118 and the external choke actuating lever 520 may move from a first position to a second position and cause the actuating pin 518 to move to an actuating position. The movement of the actuating pin 518 may engage the projections 512 and 514 and may result in a counter clockwise rotation of the external choke valve 116 to a closed choke position. In an embodiment of the present invention, an open choke position of the external choke valve 116 may be such that the external choke valve 116 may rotate in a clockwise manner to a closed choke position. Further depression(s) of the bulb 124 may not influence the position of the external choke valve 116 because the external choke actuating lever 520 may not be rotatable beyond a second position in the direction E.

In an embodiment of the present invention, a locking lever 522 may be provided to actuate a trigger member 524 between an unlocking position and a locking position. A surface 526 of the external choke actuating lever 520 may engage with the locking lever 522, thereby resulting in a rotation of the locking lever 522 about a pivot 528. In an embodiment of the present invention, the locking lever 522 may include an angled surface 530 that may engage with the surface 526. Once the bulb assembly 118 is depressed to a second position, the bulb assembly 118 may be held in place by the locking lever 522 and the trigger member 524. In an embodiment of the present invention, the actuation of the throttle lever by manual or automatic means may release the trigger member 524 and reset the bulb assembly 118 to a first position.

In the drawings and specification, there have been disclosed preferred embodiments and examples of the invention and, although specific terms are employed, they are used in a generic and descriptive sense only and not for the purpose of limitation, the scope of the invention being set forth in the following claims.

What is claimed is:

1. A fuel delivery system for an internal combustion engine, the fuel delivery system comprising:

a carburetor for mixing air and fuel;

a start preparation system for removing residual fuel or air from the carburetor or introducing fuel into the carburetor before a start of the engine, the start preparation system comprising a purging system activated by a purge bulb or a priming system activated by a primer bulb; and a fuel enrichment system for providing an enriched fuel and air mixture when the engine is cranked, wherein the fuel enrichment system is connected to the start preparation system in such a way that the fuel enrichment system is enabled to be activated by depression of the purge bulb or the primer bulb of the start preparation system.

2. A fuel delivery system according to claim 1, wherein the fuel enrichment system comprises a choke system or an enrichment circuit.

3. A fuel delivery system according to claim 1, wherein the fuel enrichment system comprises a valve, and wherein the fuel enrichment system is connected to the start preparation system in such a way that at least one depression of the purge bulb or primer bulb is configured to cause movement of the valve.

4. A fuel delivery system according to claim 3, wherein the valve comprises a butterfly valve, a rotating valve, or a slide valve.

5. A fuel delivery system according to claim 1, wherein the start preparation system is a purging system.

6. A fuel delivery system according to claim 5, wherein the start preparation system comprises a purge bulb, which can be depressed at least once in order to actuate the purging system before a start of the engine.

7. A fuel delivery system according to claim 1, wherein the start preparation system is a priming system.

8. A fuel delivery system according to claim 7, wherein the start preparation system comprises a primer bulb, configured to be depressed at least once in order to actuate the priming system before a start of the engine.

9. A fuel delivery system according to claim 1, wherein the carburetor comprises a diaphragm carburetor.

10. A fuel delivery system according to claim 1, wherein the carburetor includes a throttle valve and wherein the throttle valve is a butterfly throttle valve.

11. A fuel delivery system according to claim 1, wherein the carburetor includes a throttle valve and wherein the throttle valve is a rotating throttle valve.

12. A fuel delivery system according to claim 1, wherein the fuel enrichment system comprises a choke system, configured to be activated via a lever, and wherein the lever is connected to the start preparation system in such a way that at least one depression of the purge bulb or primer bulb is configured to cause movement of the lever.

13. A fuel delivery system according to claim 1, wherein the fuel enrichment system comprises an enrichment circuit, configured to be activated via a push button, and wherein the push button is connected to the start preparation system in such a way that at least one depression of the purge bulb or primer bulb is configured to exert a force on the push button to activate the enrichment circuit.

14. A fuel delivery system according to claim 1, wherein the fuel enrichment system comprises an enrichment circuit and a choke system, and wherein the enrichment circuit and the choke system are connected such that the enrichment circuit is actuated when the choke system is activated.

15. A fuel delivery system according to claim 1, wherein the choke system is connected to the start preparation system in such a way that at least one depression of the purge bulb or primer bulb is configured to cause activation of the choke system.

16. A fuel delivery system according to claim 1, wherein the fuel enrichment system comprises an enrichment circuit and a choke system, and wherein the enrichment circuit and the choke system are connected such that the choke system is actuated when the enrichment circuit is activated.

17. A fuel delivery system according to claim 16, wherein the enrichment circuit is connected to the start preparation system in such a way that at least one depression of the purge bulb or primer bulb is configured to cause activation of the enrichment circuit system.

18. A fuel delivery system according to claim 1, further comprising a valve and an actuating member, wherein the actuating member is coupled to the valve and the purge bulb or primer bulb such that depression of the purge or primer bulb causes axial motion of actuating member which at least partially causes movement of the valve.

19. A fuel delivery system according to claim 1, further comprising a valve and a shaft or rod, wherein the shaft or rod is coupled to the valve and the purge bulb or primer bulb such that depression of the purge or primer bulb causes movement of the valve through rotation of the shaft or rod.

20. A fuel delivery system according to claim 1, comprising a choke system external to the carburetor, which can be activated by a lever, and wherein the lever is connected to the start preparation system in such a way that at least one depression of the purge bulb or primer bulb is configured to cause movement of the lever.

21. A fuel delivery system according to claim 1, wherein the start preparation system comprises a resilient domed bulb, a bulb chamber, a bulb outlet line for moving air or fuel from the bulb chamber to a fuel supply tank in response to at least one depression of the resilient domed bulb, and a bulb inlet line for drawing air or fuel from a component of the carburetor to the bulb chamber in response to at least one depression of the resilient domed bulb.

22. A fuel delivery system according to claim 1, wherein the fuel enrichment system comprises a choke valve, and wherein the fuel enrichment system is connected to the start preparation system in such a way that at least one depression of the purge bulb or primer bulb is configured to cause rotation of the choke valve to a starting position.

23. A fuel delivery system according to claim 1, wherein the purge bulb or the primer bulb of the start preparation system comprises a bulb, and wherein the fuel delivery system is configured such that at least one depression of the bulb causes the bulb to be displaced from a first position to a second position and at least temporarily locked in the second position so that at least some subsequent depressions of the bulb do not influence the position of the bulb, the second position corresponding to activation of the fuel enrichment system.

24. A fuel delivery system according to claim 23, further comprising a throttle lever, wherein activation of the throttle lever causes the bulb to be reset to the first position.

* * * * *